US010895070B2

(12) United States Patent
Hodge

(10) Patent No.: US 10,895,070 B2
(45) Date of Patent: Jan. 19, 2021

(54) CLOSET CARRIER ASSEMBLY WITH A WASTE PIPE HAVING A COUPLING HORN

(71) Applicant: Watts Regulator Co., North Andover, MA (US)

(72) Inventor: Gary Hodge, Rutherfordton, NC (US)

(73) Assignee: Watts Regulator Co., North Andover, MA (US)

( * ) Notice: Subject to any disclaimer, the term of this patent is extended or adjusted under 35 U.S.C. 154(b) by 0 days.

(21) Appl. No.: 16/275,867

(22) Filed: Feb. 14, 2019

(65) Prior Publication Data

US 2020/0263408 A1 Aug. 20, 2020

(51) Int. Cl.
*E03D 11/14* (2006.01)

(52) U.S. Cl.
CPC ..... *E03D 11/14* (2013.01)

(58) Field of Classification Search
CPC ..... E03D 11/14
USPC ..... 4/252.2
See application file for complete search history.

(56) References Cited

U.S. PATENT DOCUMENTS 2,591,060 A 4/1952 Garretson
2,942,277 A * 6/1960 Manas ..... E03D 11/143 4/252.3
3,078,477 A * 2/1963 Schmid ..... E03D 11/14 4/252.3
3,271,794 A * 9/1966 Flegel ..... E03D 11/143 4/252.2
3,323,143 A * 6/1967 Pope ..... E03D 11/143 4/252.3
3,686,695 A * 8/1972 Mielback ..... E03D 11/143 4/252.3
3,732,582 A 5/1973 Mielbeck et al.
4,058,859 A 11/1977 Arrowood
4,108,477 A 8/1978 Morris
4,979,239 A * 12/1990 Klein ..... A47K 1/04 4/645
6,301,838 B1 10/2001 Hall
6,679,460 B2 * 1/2004 Nicolia ..... F16L 3/133 248/316.5
6,928,669 B2 8/2005 Akin
6,979,027 B2 * 12/2005 Hetzler ..... E03D 11/14 285/337
7,571,497 B2 8/2009 Hetzler et al.
8,141,177 B1 3/2012 Majocka et al.
8,321,967 B2 * 12/2012 Mesun ..... E03D 11/18 4/420
8,505,124 B2 8/2013 Eichler et al.
(Continued)

*Primary Examiner* — Lori L Baker
(74) *Attorney, Agent, or Firm* — Burns & Levinson, LLP; George N. Chaelas

(57) ABSTRACT

A closet carrier assembly for a wall-mounted toilet comprising a face plate having a front face and a back face. Spacing rods, extending from the front face, have a threaded distal end with a nut to act as a stop. A retainer plate mounts on the plurality of spacing rods against the stop and defines an opening with opposing earhole extensions. A waste pipe has a front end and a cuttable back end. The front end has opposing tabs sized and configured to pass through the earhole extensions. The front end also has ridges so that when the tabs are passed through the earhole extensions and the waste pipe is rotated, the waste pipe is fixed in place by the retainer plate being captured between the tabs and the ridges.

20 Claims, 15 Drawing Sheets

(56) References Cited

U.S. PATENT DOCUMENTS

| | | | | |
|---|---|---|---|---|
| 8,528,121 | B2 * | 9/2013 | Stonecipher | E03D 11/16 4/252.1 |
| 8,544,121 | B1 | 10/2013 | Majocka et al. | |
| 8,657,343 | B2 | 2/2014 | Rodenberg et al. | |
| 8,887,319 | B2 * | 11/2014 | Whiteside | E03D 11/143 4/252.2 |
| 9,464,426 | B1 * | 10/2016 | Schaetzke | E03C 1/01 |
| 10,060,114 | B2 * | 8/2018 | Morris | E03D 11/14 |
| 10,358,805 | B2 * | 7/2019 | Tanimoto | E03D 11/146 |
| 2016/0090726 | A1 * | 3/2016 | Verdecchia | F16L 41/08 4/252.1 |

* cited by examiner

CLOSET CARRIER ASSEMBLY WITH A WASTE PIPE HAVING A COUPLING HORN

FIELD OF THE TECHNOLOGY

The subject disclosure relates to wall mount backflow toilets and the closet carrier assemblies for mounting such toilets.

BACKGROUND OF THE TECHNOLOGY

Many toilets are arranged to connect to a drain through the floor of the room. Such toilets can rely on the components resting on the floor to support the weight and assist in making the seal with the waste pipe. In contrast, wall mount toilets, which are widely used in certain circumstances, connect to a waste pipe chase through a wall rather than through the floor. A wall hung toilet connector facilitates attachment of a wall hung toilet to a waste pipe. A typical connector supports the toilet off the floor and facilitates a fluid-tight connection between the waste pipe coupled to the toilet bowl and the waste pipe chase which carries waste-water out of the system.

For many reasons, including sanitary concerns, it is important that lasting support and strong, tight seals are made along the wastewater transmission line. Often, wall hung toilets are installed as part of large commercial projects where it can be difficult to quickly install the requisite number of toilet waste systems efficiency while still ensuring a quality seal is made in every case. Typical connectors have a threaded seal between the toilet and the waste pipe. For example, see U.S. Pat. No. 6,979,027 entitled Toilet Carrier and issued on Dec. 27, 2005, which is incorporated herein by reference. Commonly, the assembly is slow and difficult. The threaded engagement can also cause failure of the seal when adjustments are made.

SUMMARY OF THE TECHNOLOGY

In view of the above, there is a need for a device which allows for quick and easy installation of wall hung toilets while effectively connecting the wall hung toilet to the waste pipe chase. In light of the needs described above, in at least one aspect, the subject technology relates to a closet carrier assembly that can be quickly and easily assembled and, if needed, de-assembled while holding the waste water passageway sealed.

In one embodiment, the subject technology is directed to a closet carrier assembly for a wall-mounted toilet comprising a face plate having a front face and a back face opposing the front face. The back face is configured to couple to a waste pipe chase. The face plate defines a central opening. A plurality of spacing rods extend from the front face, each spacing rod having a threaded distal end and a nut, wherein the nuts act as a stop. A retainer plate is mounted on the plurality of spacing rods against the stop and defines an opening aligned with the central opening of the face plate, wherein the retainer plate opening has at least one earhole extension. A waste pipe has a front end and a back end with the back end passing into the central opening for passage of waste water to the waste pipe chase. The front end of the waste pipe acts as a coupling horn. The front end has at least one tab sized and configured to pass through the at least one earhole extension. The front end also has a ridge so that when the at least one tab is passed through the at least one earhole extension and the waste pipe is rotated, the waste pipe is fixed in place by the retainer plate being captured between the at least one tab and the ridge. The closet carrier may also include a flange surrounding the central opening on the face plate, the flange having a groove with an o-ring for sealing between the face plate and the waste pipe. Support legs can extend from the face plate to the floor within the wall. Preferably, the front end of the waste pipe has an enlarged diameter relative to the back end and forms at least one slot for receiving a tool for rotating the waste pipe. A detent area on the retainer plate can create holding friction with the at least one tab.

Another embodiment of the subject technology is directed to a method for assembling a closet carrier assembly for a wall-mounted toilet comprising the steps of: providing a face plate with a front face and a back face opposing the front face wherein the face plate defines a central opening; coupling the back face to a waste pipe chase so that the central opening and an inlet of the waste pipe chase are aligned; mounting a plurality of spacing rods to extend from the front face, each spacing rod having stop; mounting a retainer plate on the plurality of spacing rods against the stop, the retainer plate defining an opening aligned with the central opening of the face plate, wherein the retainer plate opening has at least one earhole extension; providing a waste pipe having a front end and a back end, wherein the front end has at least one tab and a ridge so that a channel is formed between the at least one tab and the ridge; passing the back end of the waste pipe into the central opening of the face plate; passing the at least one tab through the at least one earhole extension until the ridge abuts the retainer plate; and rotating the waste pipe so that the waste pipe is fixed in place by the retainer plate being captured between the at least one tab and the ridge. The method may also include the steps of: verifying that the waste pipe is a proper length; and if the waste pipe is not a proper length, modifying the waste pipe to the proper length. Still another embodiment includes forming opposing slots in the front end of the waste pipe for receiving a tool for rotating the waste pipe.

It should be appreciated that the subject technology can be implemented and utilized in numerous ways, including without limitation as an assembly, a method, a process, an apparatus, a system, a device, and a method for applications now known and later developed. These and other unique features of the system disclosed herein will become more readily apparent from the following description and the accompanying drawings.

BRIEF DESCRIPTION OF THE DRAWINGS

So that those having ordinary skill in the art to which the disclosed system pertains will more readily understand how to make and use the same, reference may be had to the following drawings.

DETAILED DESCRIPTION

Figure 1:
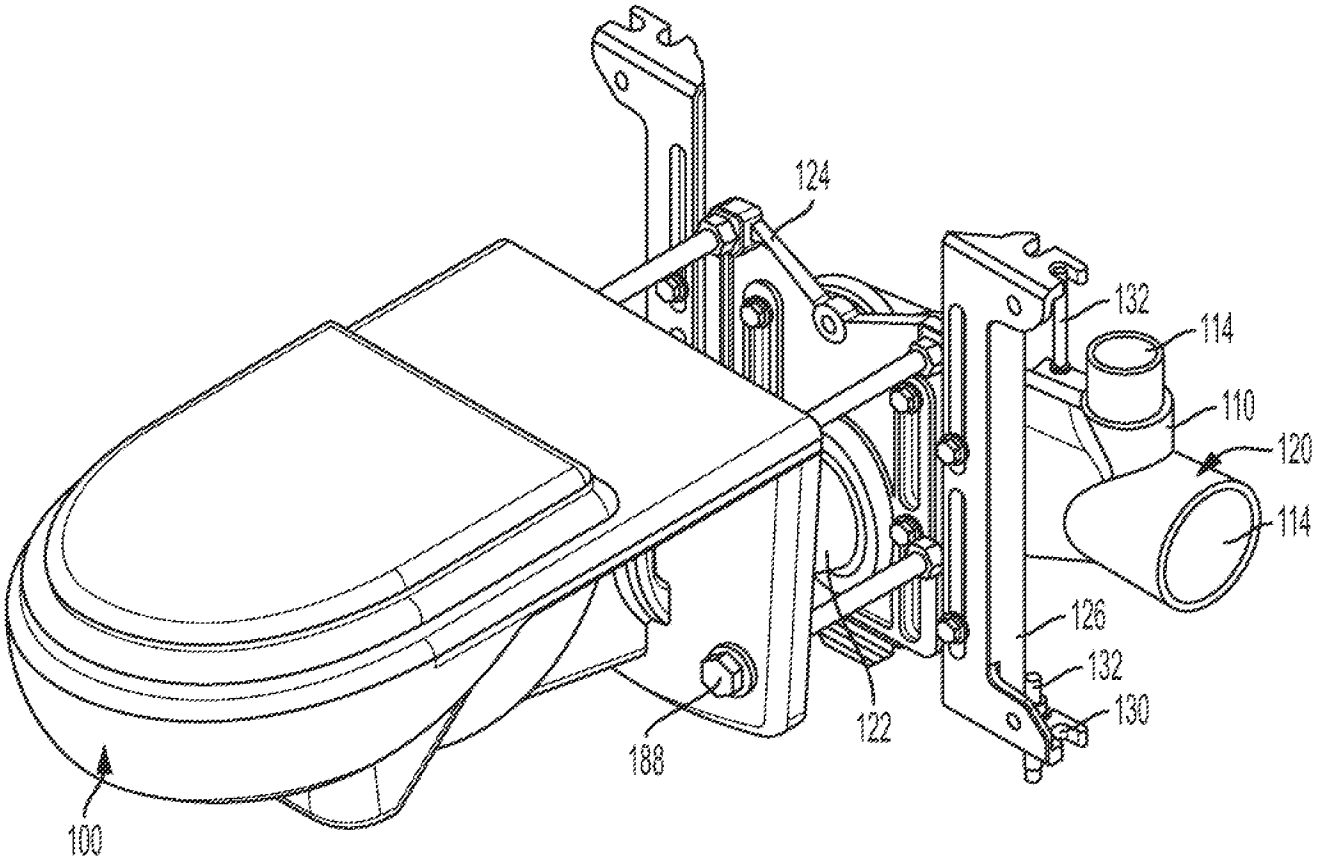
FIG. 1 is a perspective view of a wall mount toilet attached to a closet carrier assembly in accordance with the subject technology.

The subject technology overcomes many of the prior art problems associated with wall hung toilets. In brief summary, the subject technology provides for quick connection while effectively sealing the waste water passageway of a wall hung toilet. Other advantages and features of the systems and methods disclosed herein will become more readily apparent to those having ordinary skill in the art from the following detailed description of certain preferred embodiments taken in conjunction with the drawings which set forth representative embodiments of the subject technology. Like reference numerals are used herein to denote like parts. Further, words denoting orientation such as "upper", "lower", "distal", and "proximate" are merely used to help describe the location of components with respect to one another. For example, an "upper" surface of a part is merely meant to describe a surface that is separate from the "lower" surface of that same part. No words denoting orientation are used to describe an absolute orientation (i.e., where an "upper" part must always be on top).

Referring now to FIG. 1, a perspective view of a wall mounted toilet 100 with a closet carrier assembly 120 in accordance with the subject technology is shown. For clarity, the wall is not shown. When fully assembled, the toilet 100 connects to a waste pipe 122 that connects to a waste pipe chase 110 to create a waste water passageway. Each connection is tightly sealed to prevent leakage. The waste pipe chase 110 directs waste water through additional piping (not distinctly shown) into a public waste water system after the toilet 100 is flushed. The waste pipe chase 110 has inlets 114 and outlets 114 for coupling to the additional piping.

Figure 2:
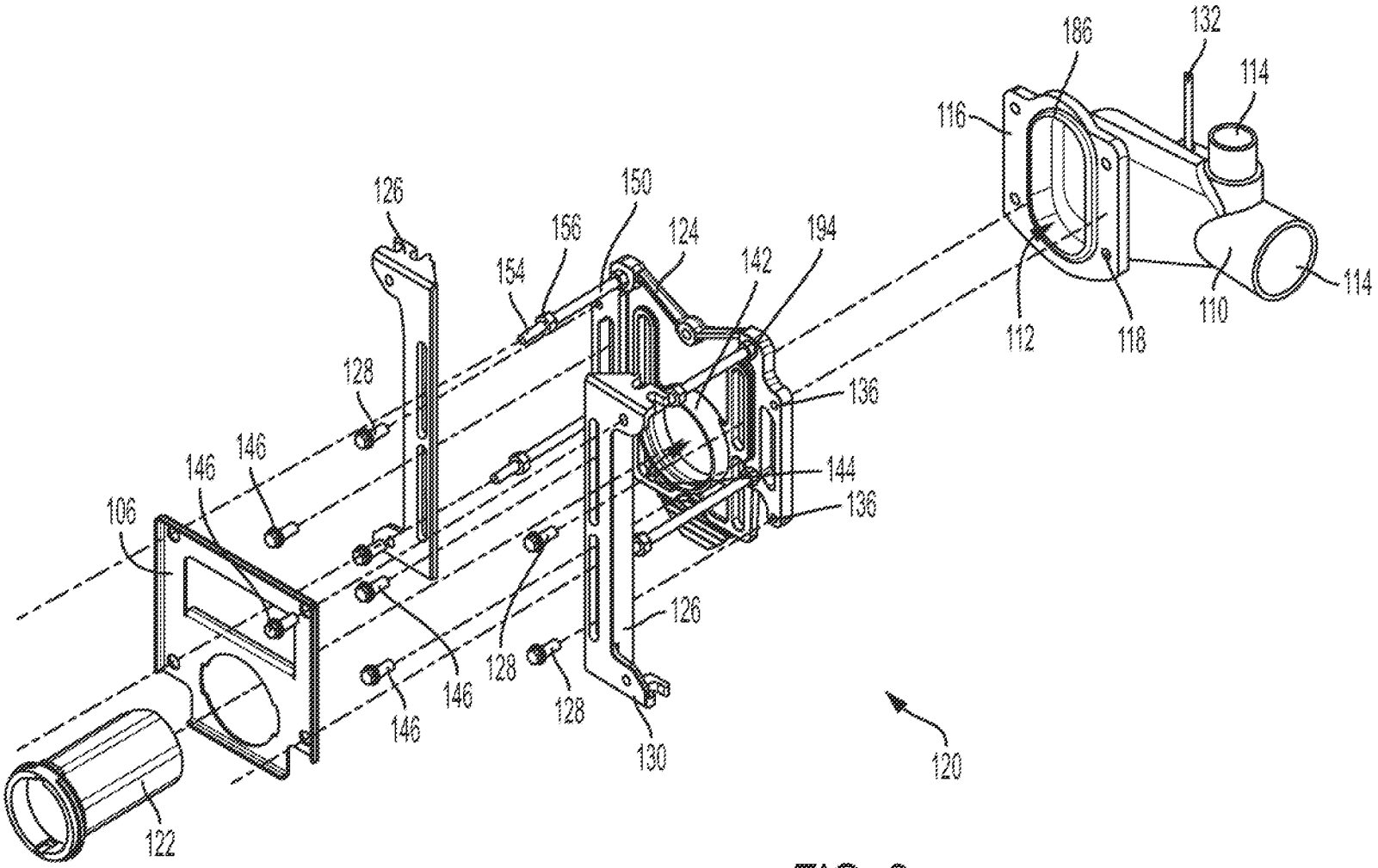
FIG. 2 is an exploded perspective view of a closet carrier assembly for a wall mount toilet in accordance with the subject technology.

Referring additionally to FIG. 2, an exploded view of the closet carrier assembly 120 in accordance with the subject technology is shown. The waste pipe chase 110 forms an oval inlet 112 that couples to the closet carrier assembly 120. Tabs 116 surround the oval inlet 112 and form a plurality of threaded mounting holes 118. The closet carrier assembly 120 includes a face plate 124 with a back face that sealingly couples to the oval inlet 112 of the waste pipe chase 110. Preferably, a gasket 186 seats between the back face of the face plate 124 and the waste pipe chase 110. The face plate 124 is typically behind the wall as is the waste pipe chase 110. Bolts 146 pass through slots 190 (best seen in FIG. 6A) in the face plate 124 into the mounting holes 118 to fix the face plate 124 and the waste pipe chase 110 together. Preferably, an anchor 132 fixes the waste pipe chase 110 in place. Typically, the components of the closet carrier assembly are fabricated from metal, ABS (acrylonitrile butadiene styrene), plastic, rubber, ceramic and the like as is known in the industry.

The closet carrier assembly 120 also include two support legs 126 that attach to the face plate 124 by bolts 128. A lower end of each leg 126 forms a foot 130 that rests on the floor (not shown). As such, the legs 126 support the face plate 124. Preferably, anchors 132 fix the legs 126 to the floor. The legs 126 can also attach to other structure for support such as a wall stud. In one embodiment, the support legs 126 are the same so that the legs are interchangeable. So that the legs 126 can easily be adjusted to support the face plate 124 at the proper height, the mounting holes 134 of the legs 126 are slots 127. Once the positioning is arranged, the bolts 128 thread into mounting holes 136 of the face plate to fix the components in place.

Figure 5C:
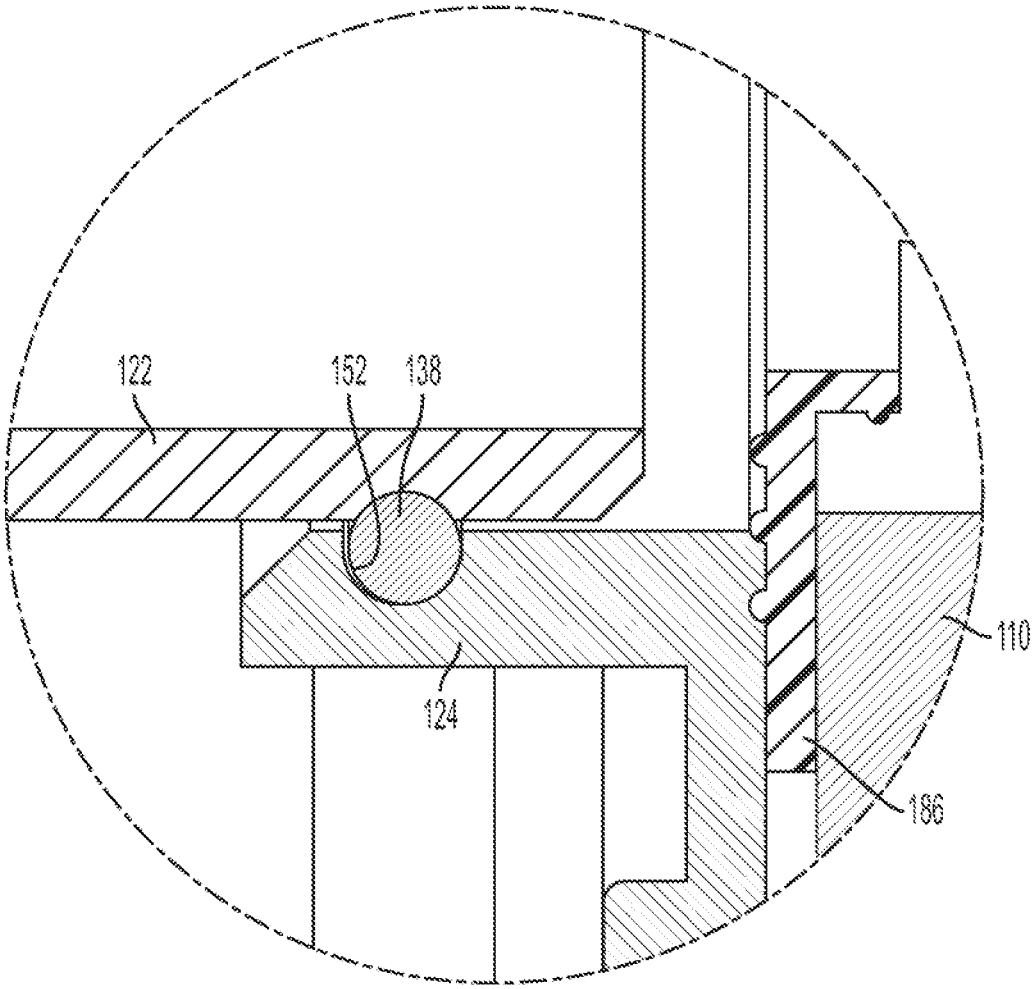
FIG. 5C is a detailed view of a portion of the assembled closet carrier assembly identified in circle C of FIG. 5B.
Figure 6A:
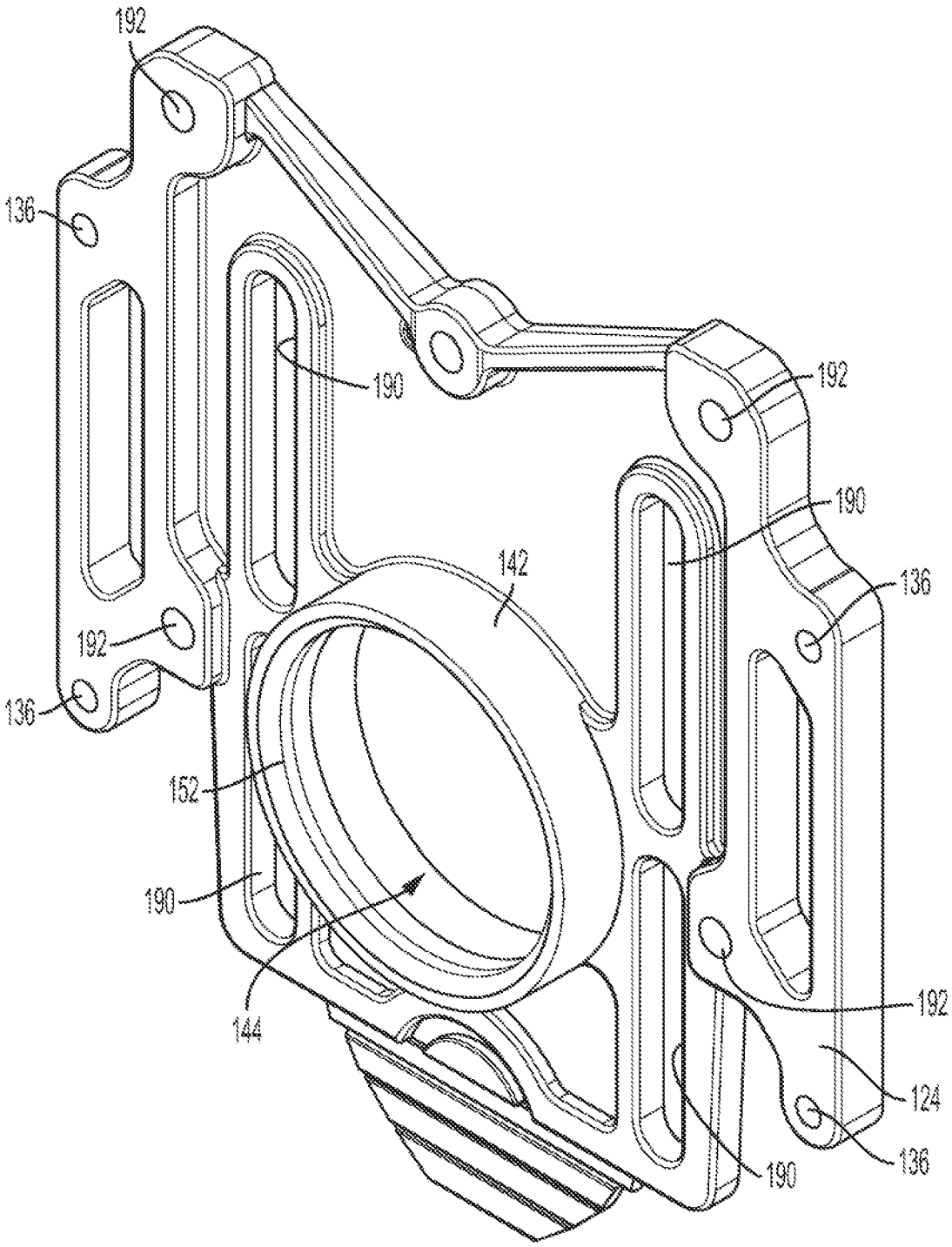
FIG. 6A is a perspective view of a face plate for a closet carrier assembly in accordance with the subject technology.
Figure 6B:
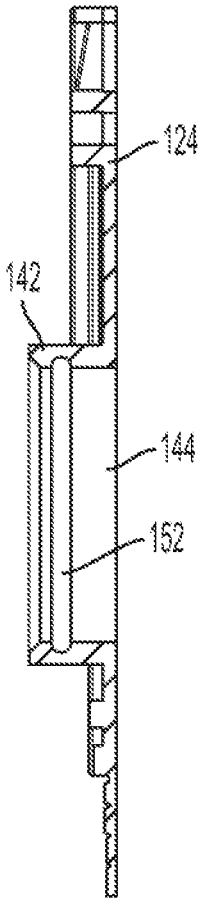
FIG. 6B is a cross-sectional view of a face plate for a closet carrier assembly in accordance with the subject technology.

Referring to FIGS. 6A and 6B, the face plate 124 is shown in an isolated perspective view and a side cross-sectional view, respectively. The face plate 124 has a front face 140 and opposing back face (not explicitly shown). The front face 140 has a flange 142 surrounding a central opening 144. The central opening 144 is aligned with the oval inlet 112. The circular flange 142 has an annular groove 148 on the inner diameter thereof. The annular groove 148 retains a sealing o-ring 152 (see FIG. 5C).

Referring again to FIG. 2, four support rods 150 extend from the front face 140. The support rods 150 have threaded proximal ends (not explicitly shown) that screw into threaded mounting holes 192 (best seen in FIG. 6A) in the face plate 124. A nut 194 can set a depth to which each support rod 150 is inserted into the face plate 124. As such, the spacing that the support rods 150 provide can be varied to match a distance required for the particular wall installation. In another embodiment, to fix the depth of the support rods 150 into the face plate 124, lock washers and/or additional nuts on the back face side are utilized. Each rod 150 also has a threaded distal end 154 with a nut 156 threaded thereon.

Figure 3:
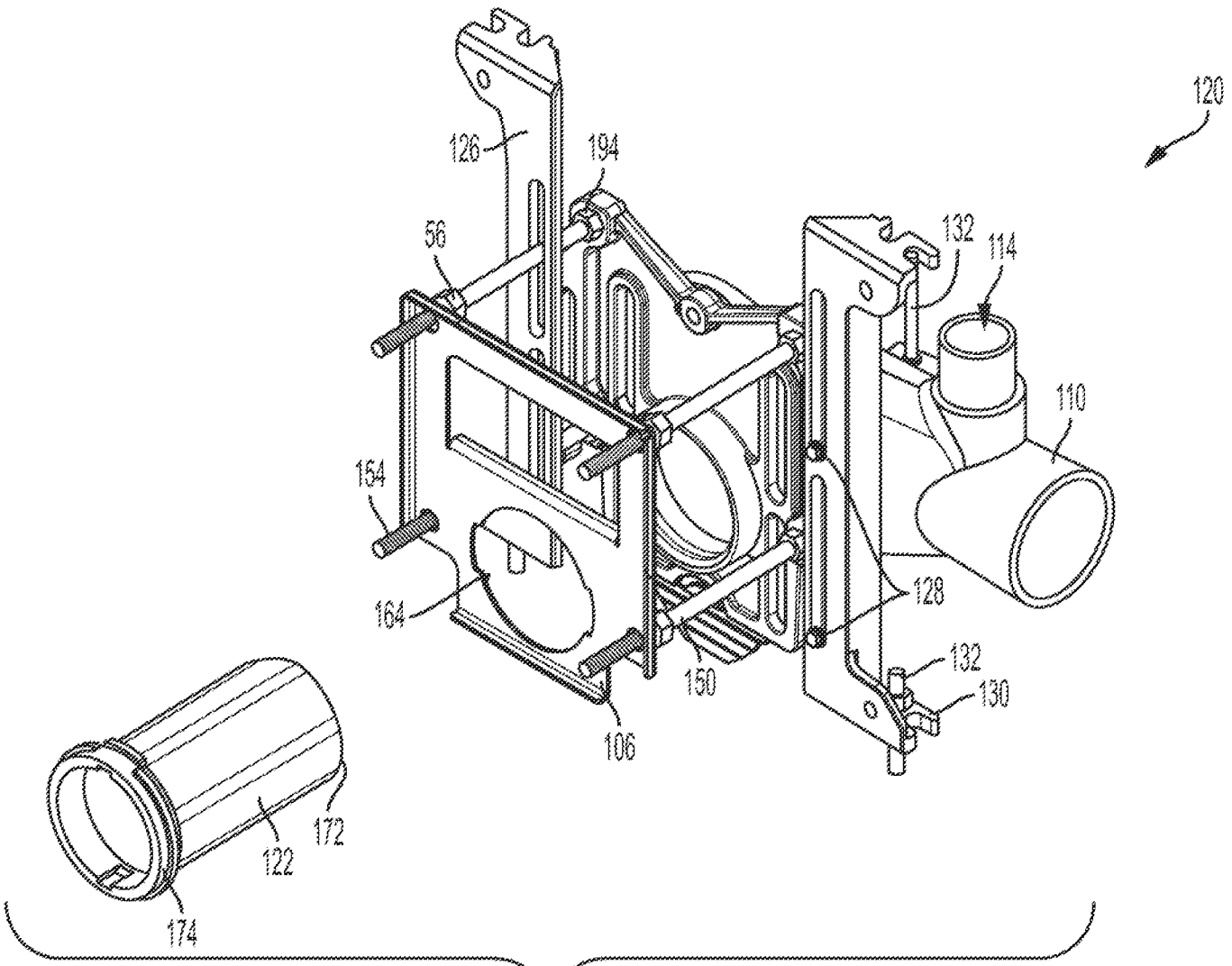
FIG. 3 is a partially exploded perspective view of components for a closet carrier assembly for a wall mount toilet in accordance with the subject technology.

As shown in FIG. 3, a retainer plate 106 mounts on the support rods 150 against the nuts 156. In effect, the nuts 156 act as a stop for the retainer plate 106. The mounting of the support rods 150 and the position of the nuts 156 are selected to mount the retainer plate 106 approximately flush with the wall.

Figure 7A:
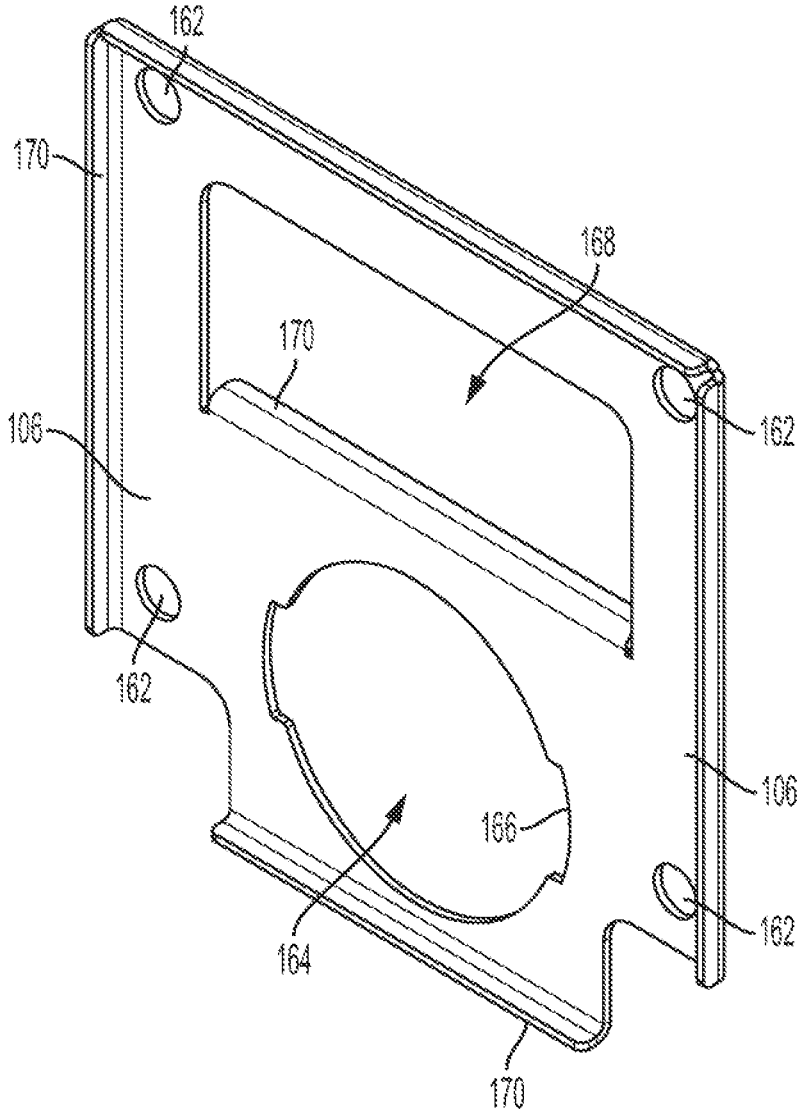
FIG. 7A is a perspective view of a retainer plate for a closet carrier assembly in accordance with the subject technology.
Figure 7B:
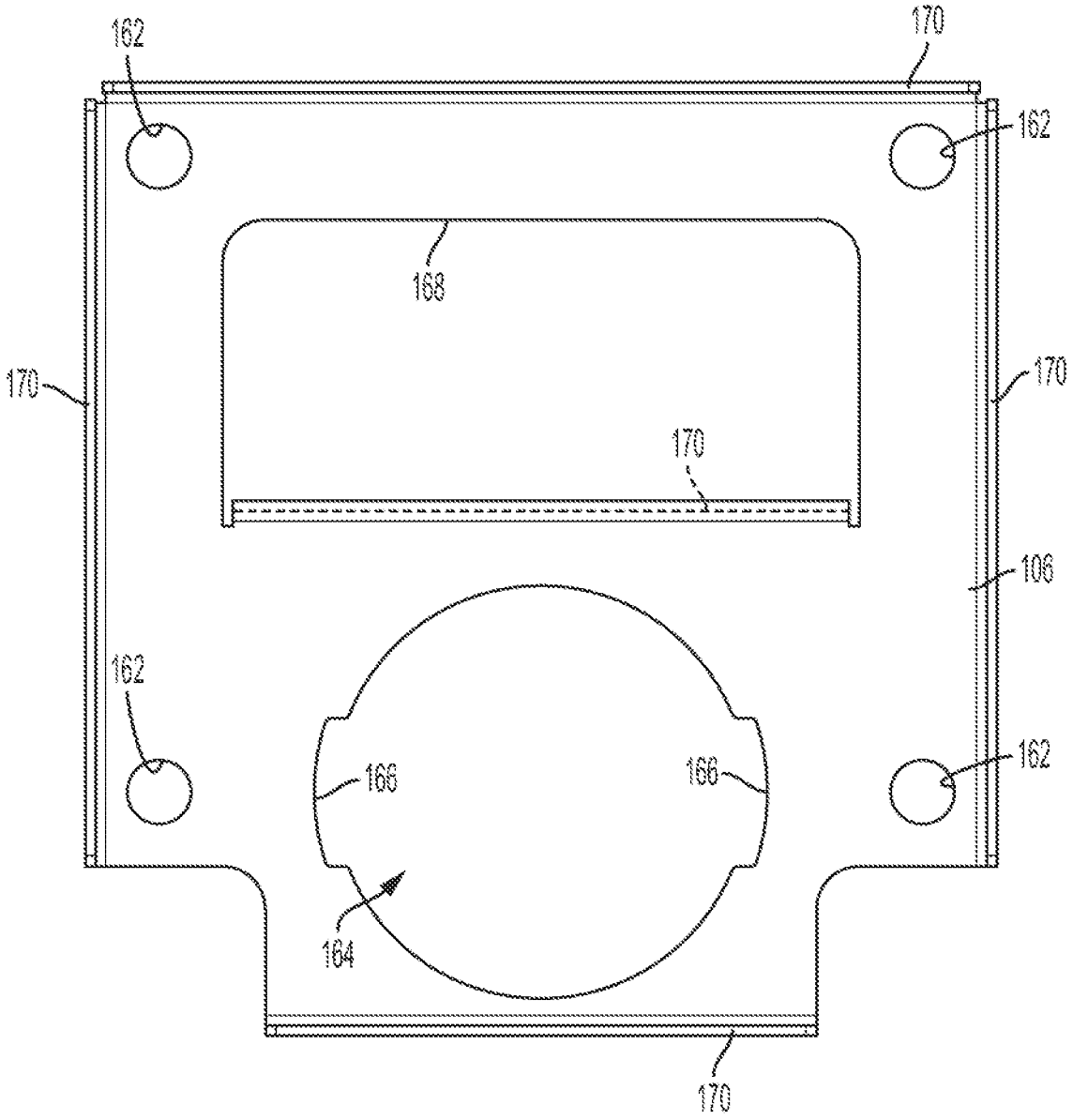
FIG. 7B is a front plant view of a face plate for a closet carrier assembly in accordance with the subject technology.
Figure 8B:
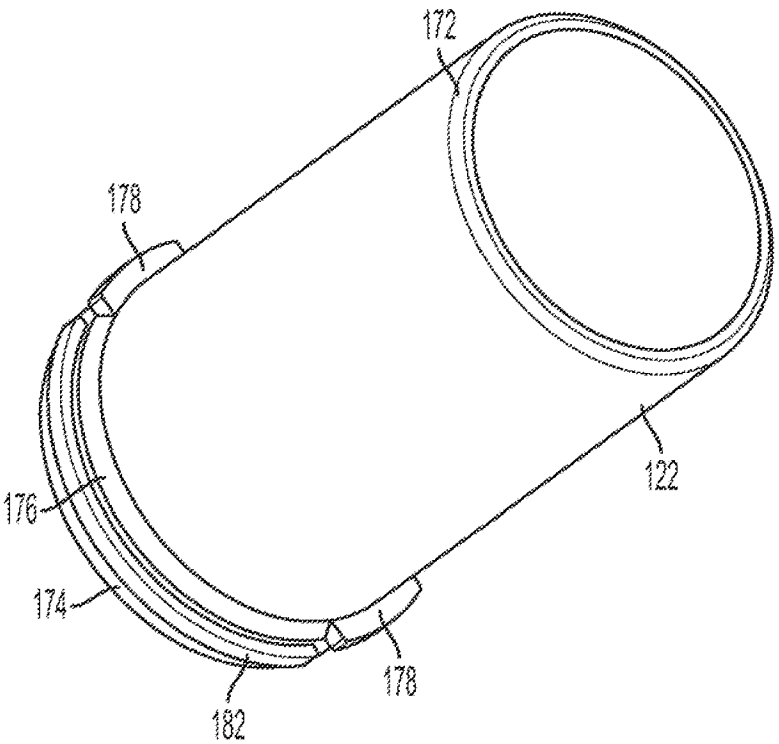
FIG. 8B is a rear perspective view of a waste pipe for a closet carrier assembly in accordance with the subject technology.
Figure 8A:
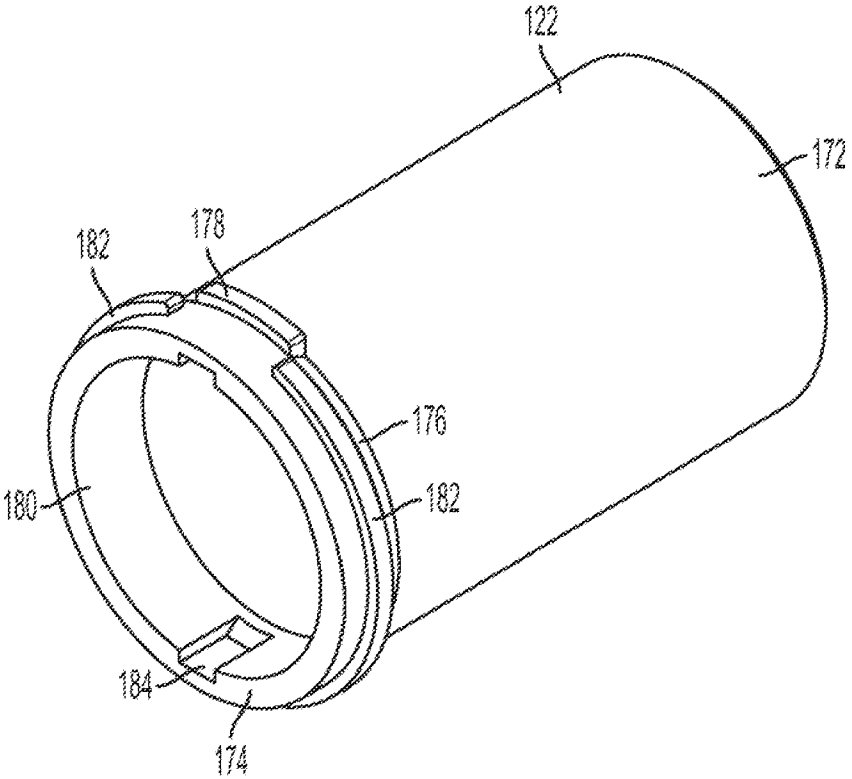
FIG. 8A is a front perspective view of a waste pipe for a closet carrier assembly in accordance with the subject technology.
Figure 8C:
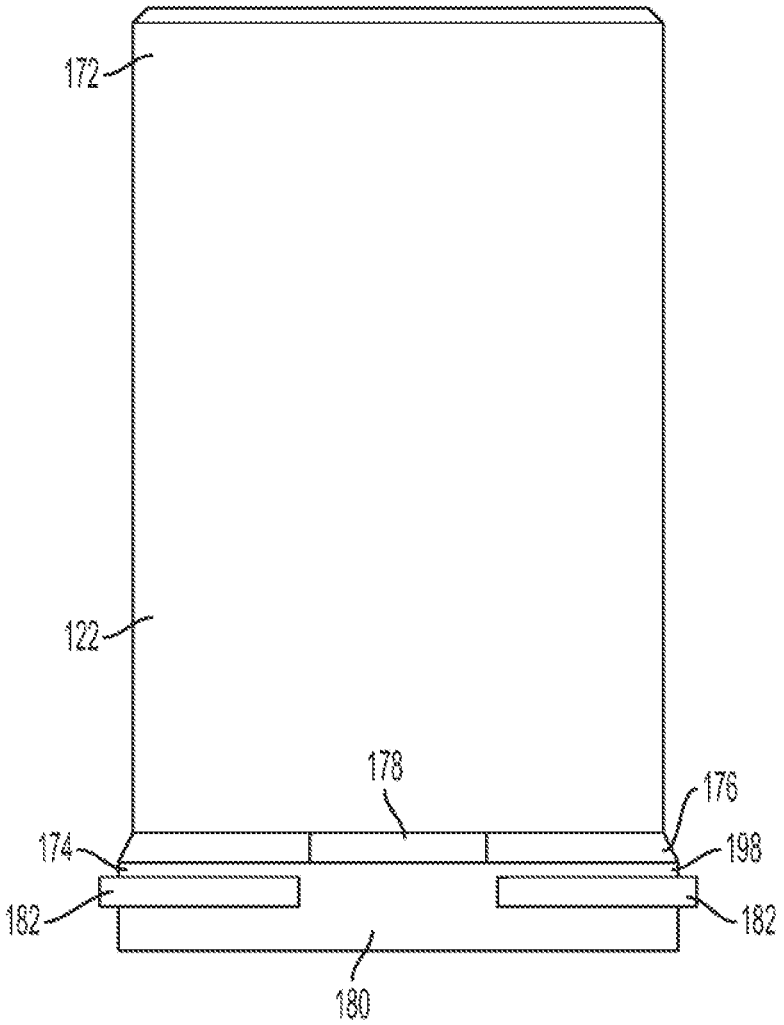
FIG. 8C is a side view of a waste pipe for a closet carrier assembly in accordance with the subject technology.
Figure 8E:
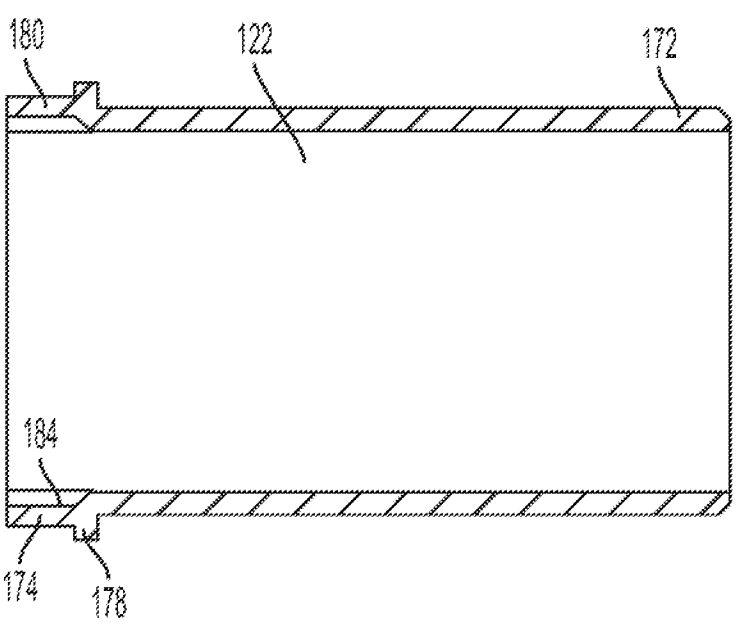
FIG. 8E is a cross-sectional view of a waste pipe taken along line E-E of FIG. 8D.
Figure 8D:
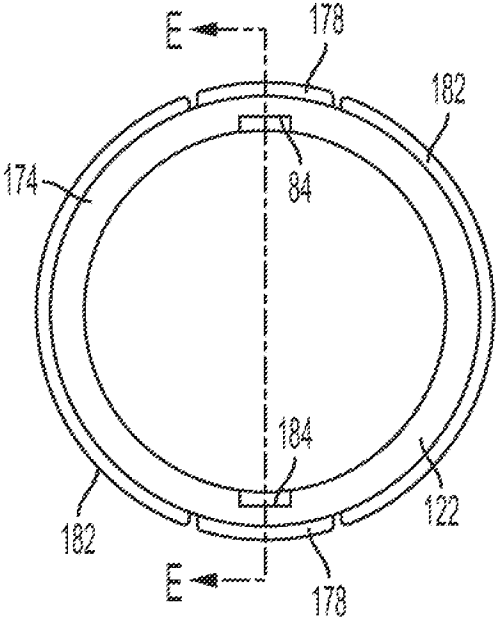
FIG. 8D is a front plan view of a waste pipe for a closet carrier assembly in accordance with the subject technology.

As best seen in FIGS. 7A and 7B, the retainer plate 106 forms four mounting holes 162 for receiving the support rods 150. A lower opening 164 is similarly sized to and aligns with the central opening 144 of the face plate 124. The lower opening 164 has two opposing earhole extensions 166 at the 3 o'clock and 9 o'clock positions. The retainer plate 106 also forms an upper hole 168. The retainer plate 106 and the upper hole 168 also have edges 170 that are curled for extra rigidity.

Figure 4:
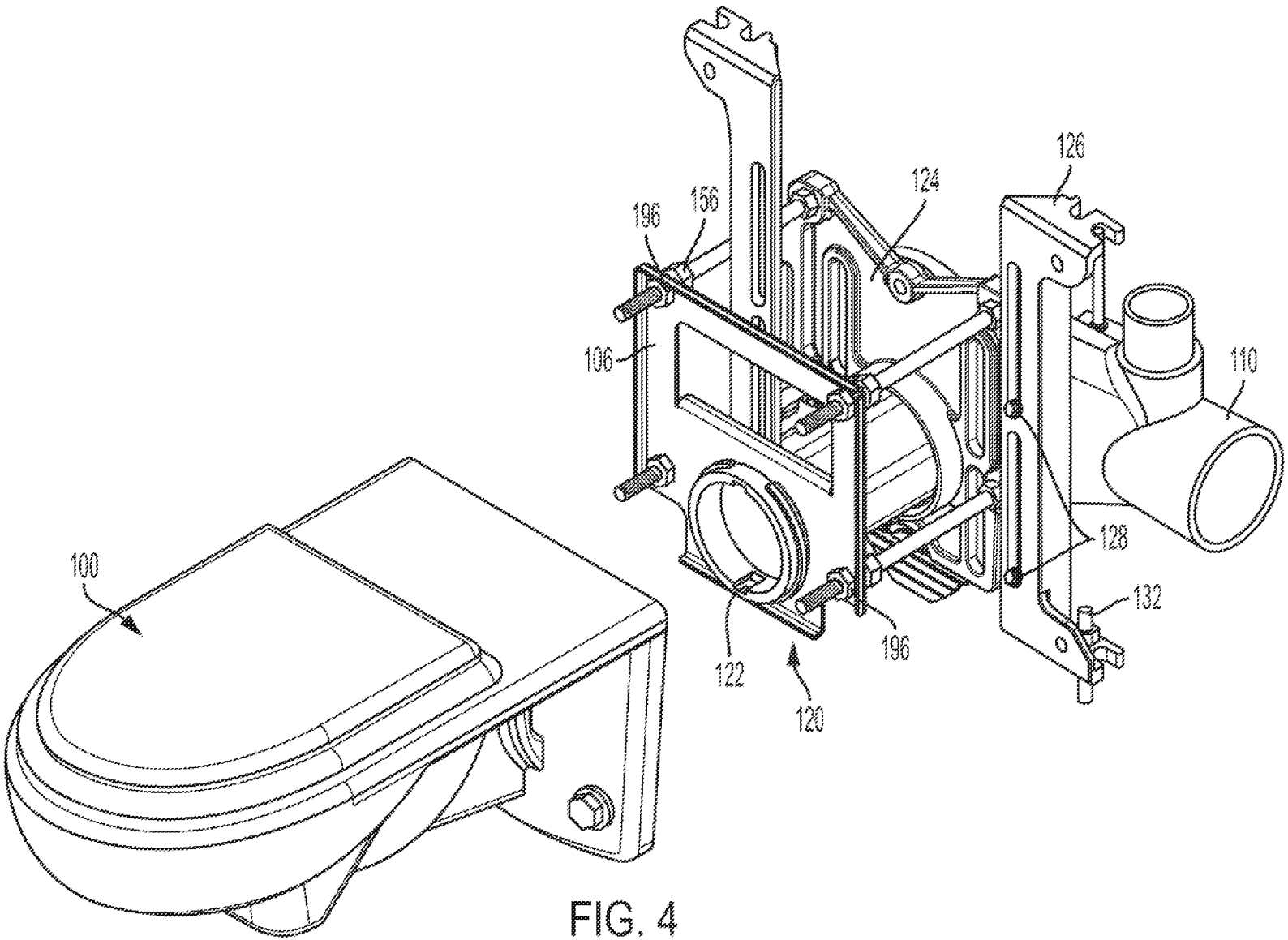
FIG. 4 is another partially exploded perspective view of components for a closet carrier assembly for a wall mount toilet in accordance with the subject technology.

Referring additionally to FIG. 4, nuts 196 lock down the retainer plate 106 against the stop nuts 156. Then, the waste pipe 122 couples into the lower opening 164 of the retainer plate 106. As best seen in FIGS. 8A-E, the waste pipe 122 has a back end 172 that may be cut to suit a depth of the wall. The waste pipe 122 has a front end 174 that forms a coupling horn to engage the retainer plate 106. The front end 174 has a transition area 176 to an enlarged diameter area 180 compared to the rest of the waste pipe 122. Two opposing tabs 178 extend radially from the transition area 176. The tabs 178 are separated by 180° and configured to pass through the earhole extensions 166 of the retainer plate 106. The enlarged diameter area 180 has two opposing arcuate ridges 182 on the outer circumference so that a channel 198 is formed between the opposing tabs 178 and the ridges 182. On the inner diameter of the enlarged diameter area 180, two opposing slots 184 are formed.

Figure 5A:
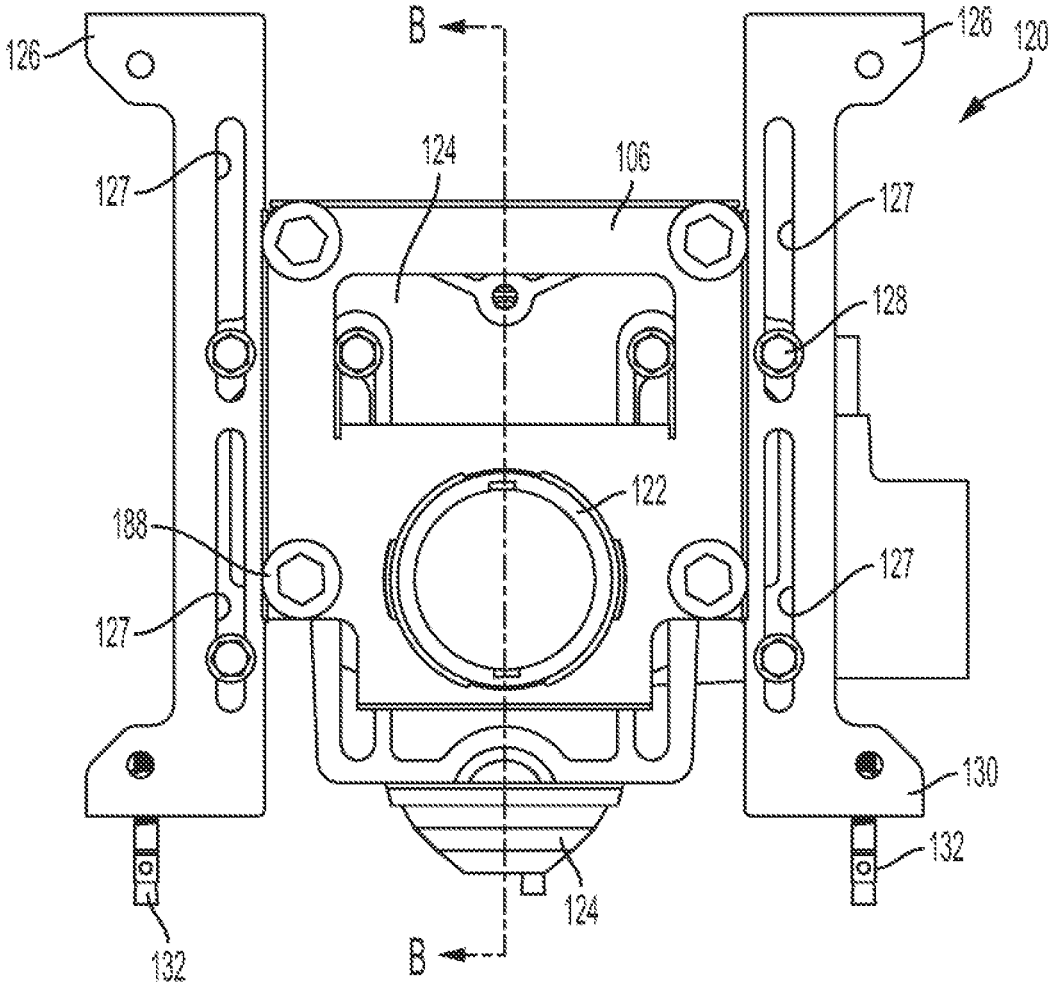
FIG. 5A is a front view of an assembled closet carrier assembly in accordance with the subject technology.
Figure 5B:
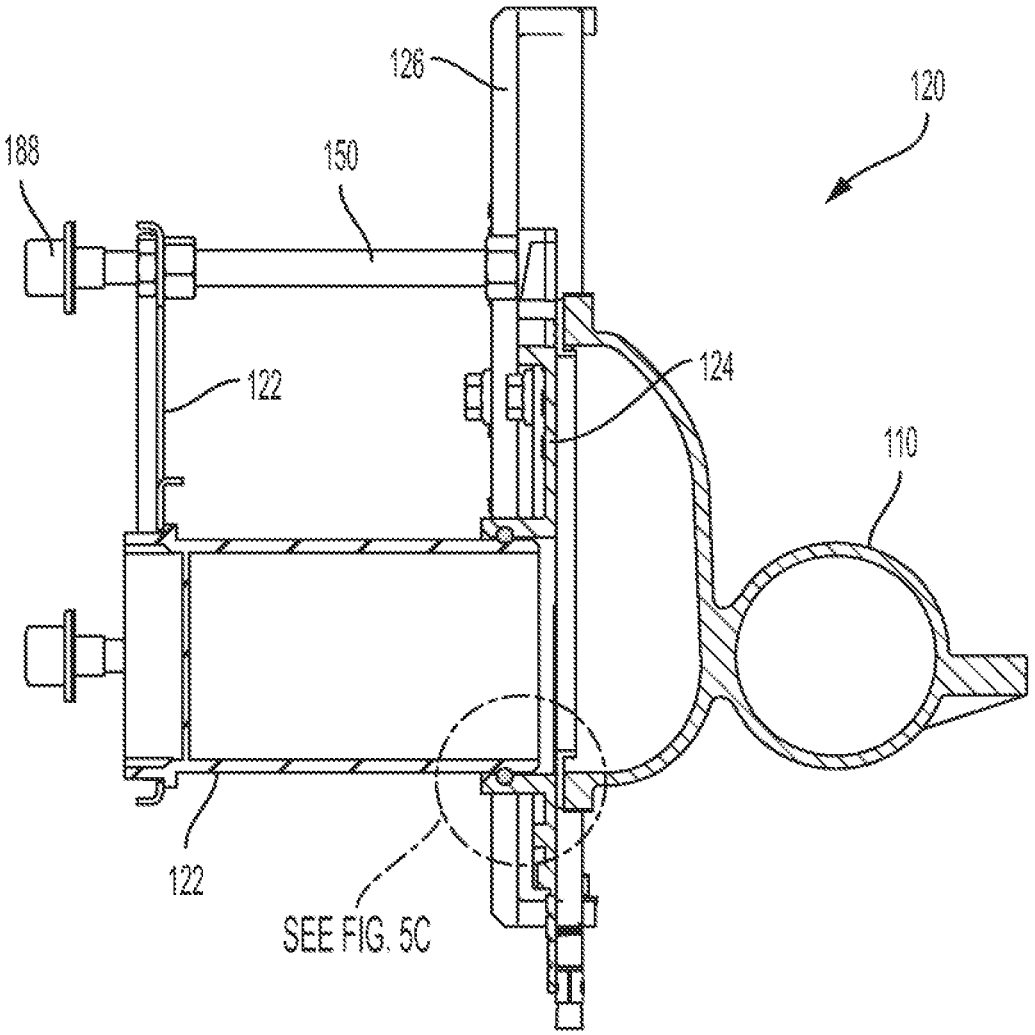
FIG. 5B is a cross-sectional view of the assembled closet carrier assembly taken along line B-B of FIG. 5A.

Referring to FIGS. 5A and 5B, the closet carrier assembly 120 is shown assembled in front and cross-sectional views, respectively. To assemble the closet carrier assembly 120 and the toilet 100, the face plate 124 and support legs 126 are assembled to the waste pipe chase 110 so that the opening 144 aligns with the oval inlet 112 in a fluid tight manner. Typically, the gasket 186 sandwiched between the chase 110 and face plate 124 facilitates the fluid tight seal (see FIG. 5C). As noted above, the legs 126 support the face plate 124 inside the wall. The spacing rods 150 are set to mount the retainer plate 106 approximately flush with the wall.

Figure 9:
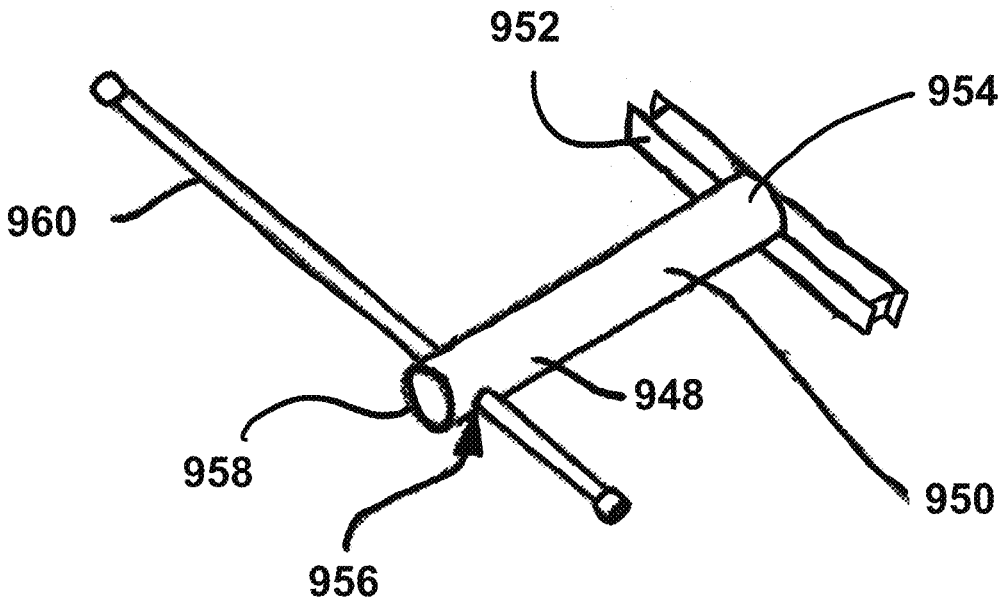
FIG. 9 shows a tool for use with a closet carrier assembly in accordance with the subject technology.

The back end 172 of the waste pipe 122 is inserted through the opening 164 of the retainer plate 106 into the central opening 144 of the flange 142 of the face plate 124 with the tabs 178 passing through the earhole extensions 166. If the waste pipe 122 is too long, the waste pipe 122 can be removed for cutting the back end 172 to a desired length. Once the waste pipe 122 is the desired length, the back end 172 is re-inserted until the ridges 182 contact the retainer plate 106. To lock the waste pipe 122 in place, the waste pipe 122 is rotated so that the tabs 178 pass onto the opposite side of the retainer plate 106 as the ridges 182. As a result, the retainer plate 106 is captured snugly in the channel 198 between the tabs 178 and ridges 182. In one embodiment, a tool (not shown) is inserted into the slots 184 of the waste pipe 122 to rotate the waste pipe. An exemplary rotating tool is shown in U.S. Provisional Patent Application No. 62/656,567, filed on Apr. 12, 2018 (the '567 application) and entitled WALL HUNG TOILET ASSEMBLY WITH A SLOPED GASKET, which is incorporated herein by reference. U.S. patent application Ser. No. 16/362,181, filed Mar. 22, 2019, claims priority to the '567 application and is also entitled WALL HUNG TOILET ASSEMBLY WITH A SLOPED GASKET and published on Oct. 17, 2019 as US 20190316337 A1. Referring now to FIG. 9, the exemplary tool shown in '567 application is, for example, a carrier nipple tool 948, or a similar tool as is known in the art. The carrier nipple tool 948 includes a central bar 950 forming a "T" with a perpendicular fixed member 952 attached at a distal end 954. The carrier nipple tool 948 also has a transverse hole 956 at a proximate end 958 within which a slidable member 960 resides. The fixed member 952 can be is inserted into the slots 184 of the waste pipe 122 to rotate the waste pipe 122. The slidable member 960 can then be gripped by the user to rotate the carrier nipple tool 948.

In one embodiment, the face plate 124 is approximately 13.125 by 12.75 inches. The retainer plate 106 is 10.75 by 11.25 inches. The waste pipe 122 is approximately 8 inches long and varies in diameter from 4.5 to 4.75 inches. The tabs 178 and ridges 180 may be 0.25 inches thick.

In one embodiment, the tabs 178 and/or the ridges 182 are ramped shaped to facilitate rotation and provide a tight fit. In another embodiment, the retainer plate 106 forms a detent area for each tab to come to rest in as a fully rotated position. For example, the detent area may be at the 12 o'clock and 6 o'clock positions. The detent may be a stamped indentation formed in the retainer plate. In another embodiment, the detent is one or more protrusions formed in the retainer plate to act as a rotational stop for the tabs and/or ridges. In another embodiment, the retainer plate and tabs are conjured so that wedge shaped tabs slide by a protrusion until the tabs drop in passing over the protrusion. Additional protrusions may prevent further rotation so that although the waste pipe may be rotated for removal, additional force may be required to overcome friction created by the protrusions.

Once the waste pipe 122 is secured in the desired location, the o-ring 138 creates a fluid tight seal between the waste pipe 122 and face plate 124 as shown in FIG. 5C. The toilet 100 can then be mounted on the rods 150. Once the toilet 100 is placed on to the rods 150, bolts 188 attach to the threaded distal ends 154 of the spacing rods 150 to set the toilet in place. Again, gaskets and/or o-rings create a fluid tight seal between the waste pipe 122 and the toilet 100.

As can be seen, the closet carrier assembly 120 provides for easy to assemble effective assembly. By using gaskets and/or o-rings, thread sealant on the waste pipe is not required. Further, front adjustment, mounting and assembly is possible as is often required in partially finished settings. Also, the closet carrier assembly can accommodate many configurations by setting the depth/length based on the wall configuration.

While the subject technology has been described with respect to preferred embodiments, those skilled in the art will readily appreciate that various changes and/or modifications can be made to the subject technology without departing from the spirit or scope of the subject technology. For example, each claim may depend from any or all claims in a multiple dependent manner even though such has not been originally claimed.

What is claimed is:

1. A closet carrier assembly for a wall-mounted toilet comprising:

a face plate having a front face and a back face opposing the front face, the back face being configured to couple to a waste pipe chase and the face plate defining a central opening;

at least one spacing rod extending from the front face;

a retainer plate mounted on the spacing rod spaced from the face plate, the retainer plate defining an opening aligned with the central opening of the face plate; and a waste pipe having a front end and a back end, wherein:

the back end passes into the central opening for passage of waste water to the waste pipe chase; and the front end of the waste pipe includes a horn that is supported by the retainer plate.

2. A closet carrier assembly as recited in claim 1, further comprising:

a flange surrounding the central opening on the face plate, the flange having a groove; and an o-ring in the groove for sealing the face plate and the waste pipe.

3. A closet carrier assembly as recited in claim 1, further comprising support legs extending from the face plate to a floor.

4. A closet carrier assembly as recited in claim 1, wherein the front end of the waste pipe has an enlarged diameter relative to the back end and forms at least one slot for receiving a tool for rotating the waste pipe.

5. A closet carrier assembly as recited in claim 1, further comprising a detent area on the retainer plate for creating holding friction with the front end of the waste pipe.

6. A closet carrier assembly as recited in claim 1, wherein: the at least one spacing rod has a stop; the opening of the retainer plate has at least one earhole extension; and the front end of the waste pipe has at least one tab configured to pass through the at least one earhole extension for coupling the retainer plate and the waste pipe together.

7. A closet carrier assembly as recited in claim 6, wherein the at least one tab is two opposing tabs, the at least one earhole extension is two opposing earhole extensions, the plurality of spacing rods is four spacing rods, and the stop includes a nut mounted on a threaded distal end of each spacing rod.

8. A closet carrier assembly as recited in claim 1, wherein the waste pipe is secured to the retainer plate.

9. A method for assembling a closet carrier assembly for a wall-mounted toilet comprising the steps of:

providing a face plate with a front face and a back face opposing the front face, the face plate defining a central opening;

coupling the back face to a waste pipe chase so that the central opening and an inlet of the waste pipe chase are aligned;

mounting a spacing rod to extend from the front face;

mounting a retainer plate on the spacing rod spaced from the face plate, the retainer plate defining an opening aligned with the central opening of the face plate;

passing a back end of a waste pipe, the waste pipe having a front end, a back end and a horn on the front end of the waste pipe, through the opening of the retainer plate and into the central opening of the face plate; and supporting the front end of the waste pipe by the horn on the retainer plate.

10. A method as recited in claim 9, further comprising the steps of:

verifying that the waste pipe is a proper length; and if the waste pipe is not the proper length, modifying the waste pipe to the proper length.

11. A method as recited in claim 9, wherein the spacing rod includes a stop and further comprising the step of adjusting the stop by varying a depth to which the support rod is inserted into the face plate to match a distance required for the particular wall installation.

12. A method as recited in claim 9, wherein the front end of the waste pipe has at least one tab and a ridge so that a channel is formed between the at least one tab and the ridge for capturing the retainer plate and further comprising the step of supporting the face plate with legs extending from the face plate to a floor.

13. A method as recited in claim 9, further comprising the steps of forming opposing slots in the front end of the waste pipe for receiving a tool for rotating the waste pipe.

14. A method as recited in claim 9, further comprising the step of securing a front end of the waste pipe to the retainer plate.

15. A closet carrier assembly for a wall-mounted toilet comprising:

a face plate having a front face and a back face opposing the front face, the back face being configured to couple to a waste pipe chase and the face plate defining a central opening;

a spacing rod extending from the front face, the spacing rod having a stop;

a retainer plate coupled to the spacing rod spaced from the face plate, against the stop, the retainer plate defining an opening aligned with the central opening of the face plate; and a waste pipe having a front end, a horn that is on the front end of the waste pipe, and a back end, wherein the back end of the waste pipe passes into the central opening for passage of waste water to the waste pipe chase and the waste pipe is fixed in place by the retainer plate coupled to the horn.

16. A closet carrier assembly as recited in claim 15, wherein: the retainer plate opening has an earhole extension; the front end has a tab sized and configured to pass through the earhole extension; and the front end has a ridge so that when the tab is passed through the earhole extension and the waste pipe is rotated, the waste pipe is fixed in place by the retainer plate being captured between the tab and the ridge.

17. A closet carrier assembly as recited in claim 15, further comprising a flange surrounding the central opening on the face plate, the flange having a groove; and an o-ring in the groove for sealing the face plate and the waste pipe.

18. A closet carrier assembly as recited in claim 15, wherein the front end of the waste pipe has an enlarged diameter relative to the back end and forms a slot for receiving a tool for rotating the waste pipe.

19. A closet carrier assembly as recited in claim 15, further comprising a detent area on the retainer plate for creating holding friction with the tab.

20. A closet carrier assembly as recited in claim 15, further comprising three spacing rods extending from the front face of the face plate.

* * * * *